US006994630B2

(12) United States Patent
Paesang

(10) Patent No.: US 6,994,630 B2
(45) Date of Patent: Feb. 7, 2006

(54) JUVENILE ACTIVITY CENTER

(75) Inventor: Chinawut P. Paesang, Cumberland, RI (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/982,321

(22) Filed: Nov. 5, 2004

(65) Prior Publication Data

US 2005/0101219 A1 May 12, 2005

Related U.S. Application Data

(60) Provisional application No. 60/518,078, filed on Nov. 7, 2003.

(51) Int. Cl.
*A63G 9/12* (2006.01)

(52) U.S. Cl. ..... 472/118; 472/472; 472/120

(58) Field of Classification Search ..... 472/118–125; 297/273, 274; 482/69, 77, 78
See application file for complete search history.

(56) References Cited

U.S. PATENT DOCUMENTS

| | | | | |
|---|---|---|---|---|
| 2,709,079 | A | 5/1955 | Bubb et al. | |
| 3,186,711 | A | 6/1965 | Morrow | |
| 3,256,016 | A * | 6/1966 | Berlin | 472/118 |
| 4,138,104 | A * | 2/1979 | D'Amicis | 472/118 |
| 4,431,183 | A | 2/1984 | Reimann | |
| 4,948,120 | A * | 8/1990 | Krueger et al. | 297/274 |
| 5,342,245 | A | 8/1994 | Webb, Jr. | |
| 5,624,321 | A * | 4/1997 | Snyder | 472/118 |
| 5,857,944 | A | 1/1999 | Cone et al. | |
| 5,876,311 | A * | 3/1999 | Coates et al. | 482/77 |
| 5,947,875 | A | 9/1999 | Cone et al. | |
| 5,961,390 | A | 10/1999 | Hoffman | |
| 5,984,792 | A | 11/1999 | Clark | |
| 6,623,368 | B1 | 9/2003 | Levi | |
| 6,648,411 | B2 * | 11/2003 | Julien | 297/274 |

* cited by examiner

*Primary Examiner*—Kien Nguyen
(74) *Attorney, Agent, or Firm*—Barnes & Thornburg LLP

(57) ABSTRACT

A juvenile activity center includes a frame, a juvenile seat, and a seat suspender. The juvenile seat can be used as a swing or a jumper.

14 Claims, 2 Drawing Sheets

JUVENILE ACTIVITY CENTER

This application claims priority under 35 U.S.C. § 119(e) to U.S. Provisional Application Ser. No. 60/518,078, filed Nov. 7, 2003, which is expressly incorporated by reference herein.

BACKGROUND

This disclosure relates to juvenile activity centers and, in particular, to juvenile swings and jumpers. More particularly, this disclosure relates to juvenile apparatus having more than one mode of operation.

Juvenile activity centers comprise a category of products for providing seating, exercise, or entertainment for young children. Examples of juvenile activity centers include swings and bouncers.

SUMMARY

A juvenile activity center in accordance with the present disclosure includes a frame, a juvenile seat, and a seat suspender coupled to the juvenile seat and to the frame. In one mode, the seat suspender supports the juvenile seat for swinging movement relative to the frame about a pivot axis to provide a juvenile swing. In another mode, the seat suspender supports the juvenile seat for up-and-down movement relative to the frame and the pivot axis to provide a juvenile jumper.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
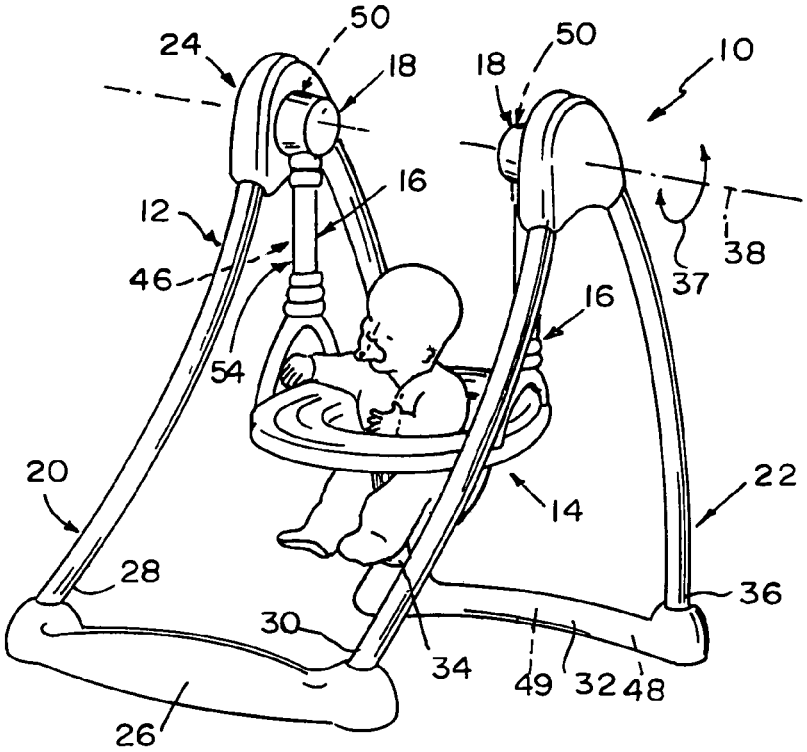
FIG. 1 is a perspective view of a juvenile activity center in accordance with the present disclosure adapted for use in a first mode of operation to provide a juvenile swing.

Juvenile activity center 10 includes a frame 12, a juvenile seat 14, and a pair of extensible hanger arms 16 coupled at an upper end to mount apparatus 18 coupled to frame 12 and a lower end to seat 14 to suspend seat 14 relative to frame 12. In a first mode of operation, shown in FIG. 1, center 10 functions only as a juvenile swing. In this swing mode, a child can rock or swing in forward and rearward directions as juvenile seat 14 swings in an arc 37 about a pivot axis 38. In a second mode of operation, shown in FIG. 2, center 10 functions only as a juvenile jumper. In this jumper mode, a child can jump or bounce up and down in directions 39 relative to pivot axis 38 but cannot swing about pivot axis 38.

Frame 12 includes a front support 20 coupled to a rear support 22 at a pair of connectors 24. Front support 20 includes a front base 26 and two front legs 28, 30 extending upwardly from front base 26 to connectors 24. Rear support 22 includes a rear base 32 and two rear legs 34, 36 extending upwardly from rear base 32 to connectors 24. As shown in FIG. 1, each support 20, 22 has a somewhat U-shaped configuration.

In the illustrated embodiment, one mount apparatus 18 is coupled to each of connectors 24 as suggested in FIG. 1. In a first mode of operation, each mount apparatus 18 is adapted (e.g., unlocked) to support hanger arms 16 for swinging movement about pivot axis 38 in an arc 37 as suggested in FIG. 1. In a second mode of operation, each mount apparatus 18 is adapted (e.g., locked) to block swinging movement of hanger arms 16 about pivot axis 38 and allow "up-and-down" movement in directions 39 as suggested in FIG. 2.

Figure 2:
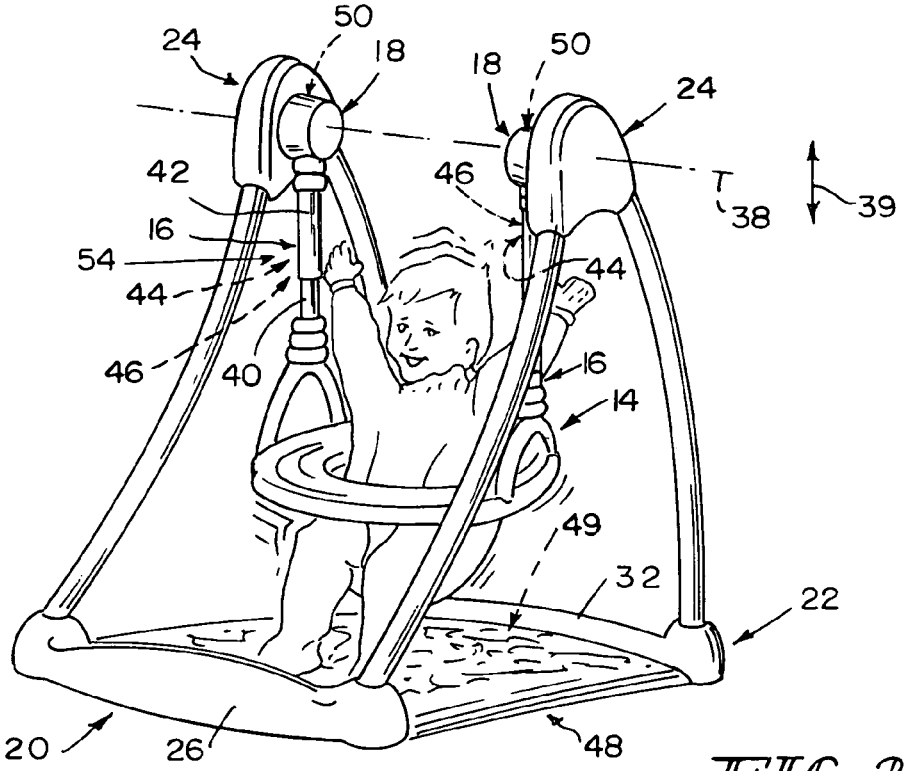
FIG. 2 is a perspective view of the juvenile activity center of FIG. 1 adapted for use in a second mode of operation to provide a juvenile jumper.
Figure 3:
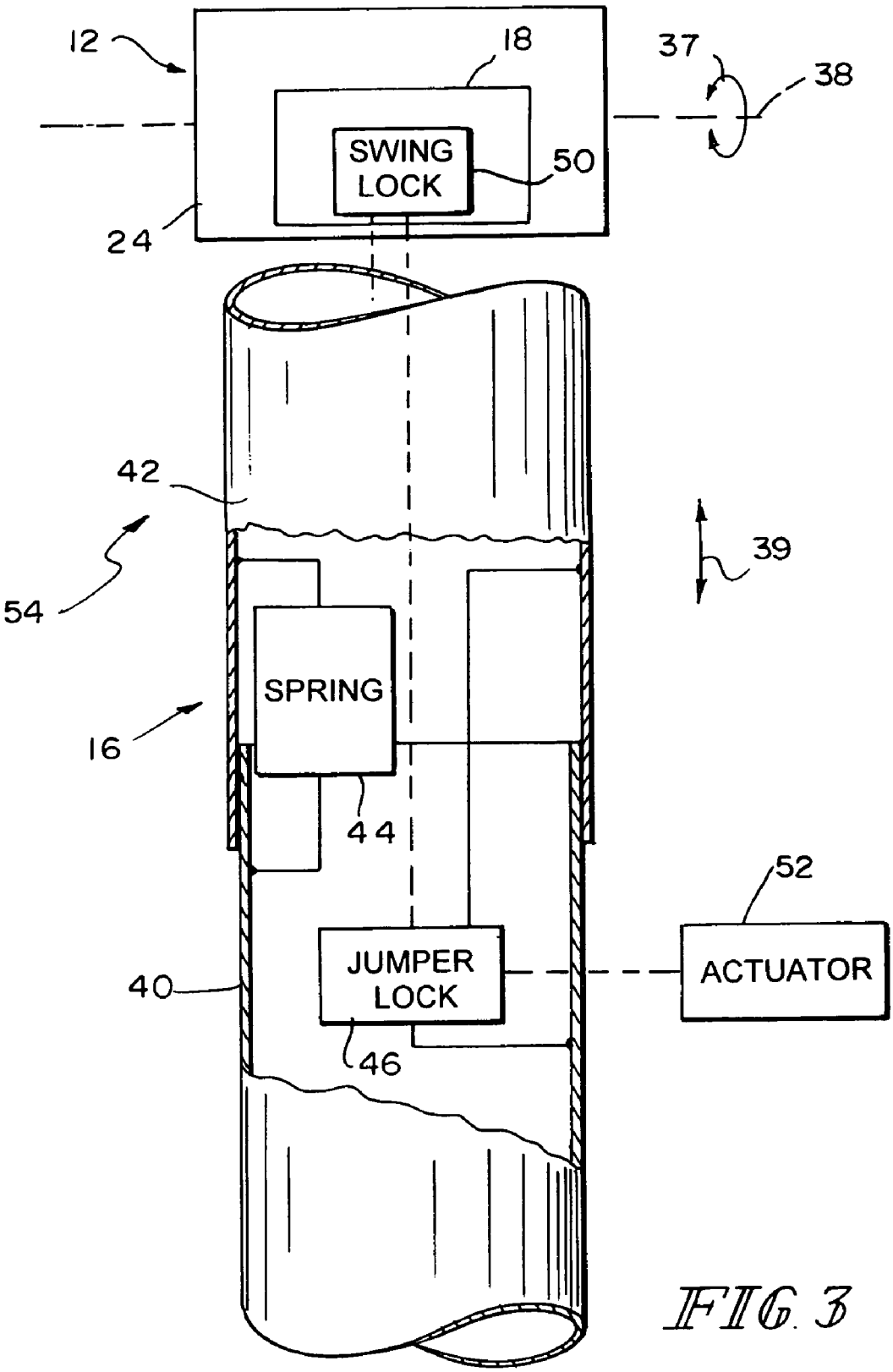
FIG. 3 is a diagrammatic view of one of the hanger arms shown in FIGS. 1 and 2 showing a spring and a lock associated with the hanger arm.

As suggested in FIGS. 2 and 3, each hanger arm 16 is extensible and includes a lower tube 40 telescopically or slidably coupled to an upper tube 42 to provide an extensible hanger arm. A spring 44 is provided for each extensible hanger arm 16 and is coupled, for example, to each of companion lower and upper tubes 40, 42 to dampen and otherwise limit movement of lower tube 40 relative to its companion upper tube 42. Lower tube 40 is coupled to seat 14 and upper tube 42 is coupled to mount apparatus 18.

A jumper lock mechanism 46 is provided for each hanger arm 16 and is adapted to lock companion lower and upper tubes 40, 42 to one another during swing mode operation to block relative movement of companion lower and upper tubes 40, 42 as suggested in FIGS. 2 and 3. In the illustrated embodiment, jumper lock mechanism 46 is used to lock lower tube 40 in a retracted position in upper tube 42 to allow seat 14 to remain at a fixed radial distance from pivot axis 38 during swinging motion of seat 14 about pivot axis 38 in arc 37 as suggested in FIG. 1. As suggested in FIG. 2, jumper lock mechanism 46 is unlocked to allow spring-dampened, telescoping (or sliding) movement of lower tube 40 relative to companion upper tube 42 and extension and retraction of lower tube 40 relative to upper tube 42 during use of center 10 as a juvenile jumper. As a juvenile seated in seat 14 jumps up and down, hanger arms 16 extend and retract to allow seat 14 to move up and down in directions 39.

Juvenile activity center 10 also includes a floor mat 48 adapted to underlie seat 14 when center 10 is used as a jumper as suggested in FIG. 2. In one embodiment, floor mat 48 is stored in or adjacent to rear base 32 and withdrawn and coupled to front base 26 to lie in a deployed position under seat 14 as shown, for example, in FIG. 2. In one embodiment, a floor mat storage region 49 is provided in rear base 32. Floor mat 48 could alternatively be stored in or adjacent to front base and coupled to rear base 32 in a deployed position. Floor mat 48 could be supported on a spring-loaded, wind-up roll (not shown). Floor mat 48 could comprise a pliable fabric or sheet or a bundle of linked slats.

As suggested, for example, in FIGS. 1 and 2, suspension means is provided for selectively suspending juvenile seat 14 from frame 12 in either a swing mode for swinging movement about pivot axis 38 in arc 37 relative to frame 12 and a jumper mode for non-swinging, up-and-down movement in directions 39 below pivot axis 38 and relative to frame 12. As suggested diagrammatically in FIG. 3, the suspension means includes extensible hanger arms 16 and swing lock means 50 for selectively locking hanger arm 16 to frame 12 to block swinging movement of juvenile seat 14 relative to frame 12 about pivot axis 38 in the jumper mode of activity center 10. It is within the scope of this disclosure to provide a swing lock 50 for one or both of hanger arms 16. The suspension means further includes jumper lock means 46 for selectively locking lower tube 40 to upper tube 42 and allow swinging movement of juvenile seat 14 about pivot axis 38 in the swing mode of activity center 10. An actuator 52 is provided to control locking and unlocking of jumper lock 46 and swing lock 50 for each hanger arm 16 or both hanger arms 16.

One example of a sliding or telescoping coupling of upper tube 42 and lower tube 40 in extensible hanger arm 16 is illustrated in FIG. 3. Lower tube 40 is mounted on upper tube 42 for movement relative to upper tube 42 between a retracted position shown, for example, in FIG. 1 to establish a first length of hanger arm 16 and an extended position shown, for example, in FIG. 2 to establish a greater second length of hanger arm 16. Jumper lock 46 provides means for locking lower tube 40 in the retracted position to allow juvenile seat 14 to remain at a fixed radial distance from pivot axis 38 during swinging movement of juvenile seat 14 about pivot axis 38 when juvenile seat 14 is placed in swing mode.

As suggested in FIG. 3, hanger arm 16, mount apparatus 18, spring 44, jumper lock 46, and swing lock 50 cooperate to define a link 54 interconnecting juvenile seat 54 and frame 12. Link 54 supports juvenile seat 14 for swinging movement relative to frame 12 about pivot axis 38.

What is claimed is:

1. A juvenile activity center comprising a frame, a juvenile seat, and suspension means for selectively suspending the juvenile seat from the frame in one of a swing mode for swinging movement about a pivot axis relative to the frame and a jumper mode for non-swinging, up-and-down movement below the pivot axis.

2. The activity center of claim 1, wherein the suspension means includes an extensible hanger arm interconnecting the frame and the juvenile seat and swing lock means for selectively locking the hanger arm to the frame to block swinging movement of the juvenile seat relative to the frame about the pivot axis.

3. The activity center of claim 2, wherein the extensible hanger arm includes an upper tube coupled to the frame, a lower tube coupled to the juvenile seat and telescopically coupled to the upper tube to allow extensible up-and-down movement of the lower tube relative to the upper tube in the jumper mode, and jumper lock means for selectively locking the lower tube to the upper tube to block extensible up-and-down movement of the lower tube relative to the upper tube and allow swinging movement of the juvenile seat about the pivot axis in the swing mode.

4. The activity center of claim 3, wherein the extensible hanger arm further includes spring means coupled to the upper and lower tubes for damping and limiting movement of the lower tube relative to the upper tube when the suspension means is placed in jumper mode and the jumper lock means is adjusted to unlock the lower tube for extensible up-and-down movement relative to the upper tube.

5. The activity center of claim 2, wherein the extensible hanger arm includes an upper tube coupled to the frame and a lower tube coupled to the juvenile seat and mounted on the upper tube for movement between a retracted position relative to the upper tube to establish a first length of the hanger arm and an extended position relative to the upper tube to establish a second length of the hanger arm that is greater than the first length.

6. The activity center of claim 5, wherein the extensible hanger arm further includes a jumper lock mechanism providing means for locking the lower tube in the retracted position to allow the juvenile seat to remain at a fixed radial distance from the pivot axis during swinging movement of the juvenile seat about the pivot axis when the juvenile seat is placed in the swing mode.

7. The activity center of claim 5, wherein the swing lock means is coupled to the upper tube of the hanger arm.

8. The activity center of claim 5, wherein the extensible hanger arm further includes a spring coupled to each of the lower and upper tubes to limit movement of the lower tube relative to the upper tube during up-and-down movement of the lower tube relative to the upper tube in the jumper mode.

9. The activity center of claim 5, wherein the extensible hanger arm further includes jumper means for allowing spring-dampened, telescoping movement of the lower tube relative to the upper tube and extension and retraction of the lower tube relative to the upper tube in the jumper mode of the juvenile seat during use of the activity center as a juvenile jumper.

10. The activity center of claim 1, wherein the frame includes a front support, a rear support, and a connector coupled to the front and rear support and arranged to intersect the pivot axis and the suspension means includes a hanger arm coupled to the seat and a mount apparatus coupled to the connector and to the hanger arm, and the mount apparatus is configured to block swinging movement of the hanger arm in the jumper mode of the juvenile seat.

11. The activity center of claim 10, wherein the front support includes a front base adapted to rest on a floor underlying the juvenile seat and a first front leg extending upwardly from the front base to the connector, the rear support includes a rear base adapted to rest on a floor underlying the activity center and a first rear leg extending upwardly from the rear base to the connector, and further comprising a floor mat associated with the rear base and mounted for movement between a stored position that is located away from the front base in one of in and adjacent to the rear base and a deployed position located under the juvenile seat and coupled to the front and rear bases.

12. The activity center of claim 1, wherein the frame includes a mat storage region and an extensible floor mat coupled to the frame and mounted for movement between a stored position in the mat storage region and an extended position extending under the juvenile seat.

13. A juvenile activity center comprising a frame, a juvenile seat, a link interconnecting the juvenile seat and the frame to support the juvenile seat for swinging movement relative to the frame about a pivot axis, the link including jumper means for supporting the juvenile seat in a jumper mode for up-and-down movement under and relative to the pivot axis and blocking swinging movement of the juvenile seat about the pivot axis upon placement of the juvenile seat in the jumper mode and swinger means for maintaining the juvenile seat at a fixed radial distance from the pivot axis in a swing mode to block up-and-down movement of the juvenile seat relative to the pivot axis without blocking swinging movement of the juvenile seat relative to the frame about the pivot axis.

14. A juvenile activity center comprising a frame including a front support coupled to a rear support at a connector to establish a pivot axis, a juvenile seat, and an extensible hanger arm interconnecting the juvenile seat and the connector to allow swinging movement of the juvenile seat about the pivot axis in a swing mode and up-and-down movement of the juvenile seat under and relative to the pivot axis in a jumper mode of the juvenile seat, the extensible hanger arm including swing lock means for selectively locking the extensible hanger arm to the connector of the frame in a jumper mode to block swinging movement of the juvenile seat relative to the frame about the axis and jumper lock means for blocking up-and-down movement of the juvenile seat under and relative to the pivot axis in the swing mode.

* * * * *